US005245669A

United States Patent [19]

Bittencourt

[11] Patent Number: 5,245,669

[45] Date of Patent: Sep. 14, 1993

[54] ELECTROACOUSTIC TRANSDUCER

[75] Inventor: Helio T. Bittencourt, Sao Paulo, Brazil

[73] Assignee: Leson Laboratorio De Engenharia Sonica S.A., Brazil

[21] Appl. No.: 747,790

[22] Filed: Aug. 19, 1991

[30] Foreign Application Priority Data

Aug. 30, 1990 [BR] Brazil ..... 9004306

[51] Int. Cl.[5] ..... H04R 7/16

[52] U.S. Cl. ..... 381/184; 381/182; 381/186; 381/190; 381/195; 310/324

[58] Field of Search ..... 381/182, 184, 186, 195, 381/190; 310/324

[56] References Cited

U.S. PATENT DOCUMENTS

| | | | |
|---|---|---|---|
| 2,566,850 | 9/1951 | Mott | 381/193 |
| 4,283,605 | 8/1981 | Nakajima | 381/190 |
| 4,319,098 | 3/1982 | Baitcher | 381/193 |
| 4,425,482 | 1/1984 | Bordelon et al. | 170/120 |
| 4,475,014 | 10/1984 | King | 381/190 |
| 4,996,713 | 2/1991 | Bittencourt | 310/324 |

FOREIGN PATENT DOCUMENTS 0331591 9/1989 European Pat. Off. .

*Primary Examiner*—Jin F. Ng
*Assistant Examiner*—Edward Lefkowitz
*Attorney, Agent, or Firm*—Steinberg & Raskin

[57] ABSTRACT

The invention relates to an improved piezoelectric loudspeaker for high frequency, more commonly known as a tweeter. The invention embraces a technological improvement which permits the size of the tweeter to be substantially reduced while maintaining or even improving its performance when compared to other tweeters. In the device, a diaphragm is placed at least partially inside a coil so that the size of the tweeter can be reduced. The coil activates a piezoelectric element which drives the diaphragm causing it to vibrate and produce sound.

5 Claims, 2 Drawing Sheets

ELECTROACOUSTIC TRANSDUCER

BACKGROUND OF THE INVENTION

The present invention relates generally to electroacoustic transducers and, more particularly, to high frequency electroacoustic transducers of the type driven by or driving a piezoelectric element that bends in response to electrical energy applied across it, or which produces electrical energy in response to bending or warping.

Reference is made to the applicant's U.S. Pat. Nos. 4,845,776 issued Jul. 4, 1989 and 4,996,713 issued Feb. 26, 1991, the disclosures of which are hereby incorporated by reference with respect to the descriptions therein of such electroacoustic piezoelectric transducers.

A piezoelectric element of the type conventionally used in such electroacoustic transducers comprises a pair of piezoelectric wafers having outer electrodes which are sandwiched over a conductive metallic interlayer which forms an electrode between the two wafers. The piezoelectric element has a substantially planar configuration and is relatively thin between its outer electrodes with respect to its lateral dimension thereby permitting the element to flex along its long dimensions or diameters. When an electrical signal is positive on the outer electrodes with respect to the intermediate electrode, the center of the piezoelectric element flexes in one direction. Reversing the electric field polarity causes the piezoelectric element to flex in the opposite direction. Impressing an alternating voltage across the electrodes causes the piezoelectric element to oscillate.

Electroacoustic piezoelectric transducers are known which convert alternating electric voltage to sound, thereby acting as loudspeakers. Such piezoelectric loudspeakers generally operate in high frequency ranges and are commonly known as "tweeters."

Conventional piezoelectric tweeters generally comprise a housing which encloses a diaphragm mounted for vibration, a piezoelectric element coupled to the diaphragm, and an adjacent electric conductor coil structure, which may comprise the coil of an air core transformer in an electrical circuit. The housing of the tweeter must be relatively large in its height dimension in order to accommodate the coil structure and the adjacent diaphragm.

High frequency loudspeakers or tweeters are used both by themselves, i.e., separate from low and mid-range speakers, as well as in systems in which they are physically coupled to low and/or mid-range loudspeakers. For example, a loudspeaker assembly may comprise a loudspeaker that reproduces low frequency sounds, on which is mounted one or more additional loudspeakers for reproducing medium and high range frequency sounds. However, such combined speaker construction often presents difficulties in cases where the space for mounting the speakers is limited such, for example, as in the case of automobile sound system speakers.

It is not uncommon for the loudspeakers of automobile sound systems to be mounted within the thickness of the automobile's doors. The space available for the speakers within an automobile door is generally limited since other components, such as electrical window-lifting mechanisms and door locks, among other things, are also housed within the door thickness. A problem therefore arises in situating a combined speaker construction within the door of an automobile in view of the limited space available and the relatively large height dimensions of the tweeter. In the past, the problem of limited space has been solved by using speakers having smaller dimensions and, therefore, less power and/or reduced quality, than would otherwise be desired.

SUMMARY OF THE INVENTION

It is an object of the present invention to provide new and improved electroacoustic piezoelectric transducers.

Another object of the present invention is to provide new and improved piezoelectric loudspeakers for reproducing high frequency sounds, i.e., tweeters.

Still another object of the present invention is to provide new and improved piezoelectric loudspeakers having reduced dimensions comparable to conventional loudspeakers producing the same power and sound quality.

Yet another object of the present invention is to provide new and improved piezoelectric loudspeakers having reduced dimensions such that they are capable of being mounted in locations which are normally difficult to access.

Briefly, in accordance with the present invention, these and other objects are attained by providing a construction of an electroacoustic transducer including a housing, a diaphragm mounted in the housing, a piezoelectric element coupled to the diaphragm, and a substantially ring-shaped coil structure. According to the invention, at least a part of the diaphragm is situated in the interior of the coil structure rather then laterally adjacent thereto, thereby enabling a significant reduction in the space required to accommodate the diaphragm and coil structure, and in turn permitting a reduction in the thickness of the transducer without substantially increasing its diameter, which is determined by the dimension of the diaphragm.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENT

Figure 1:
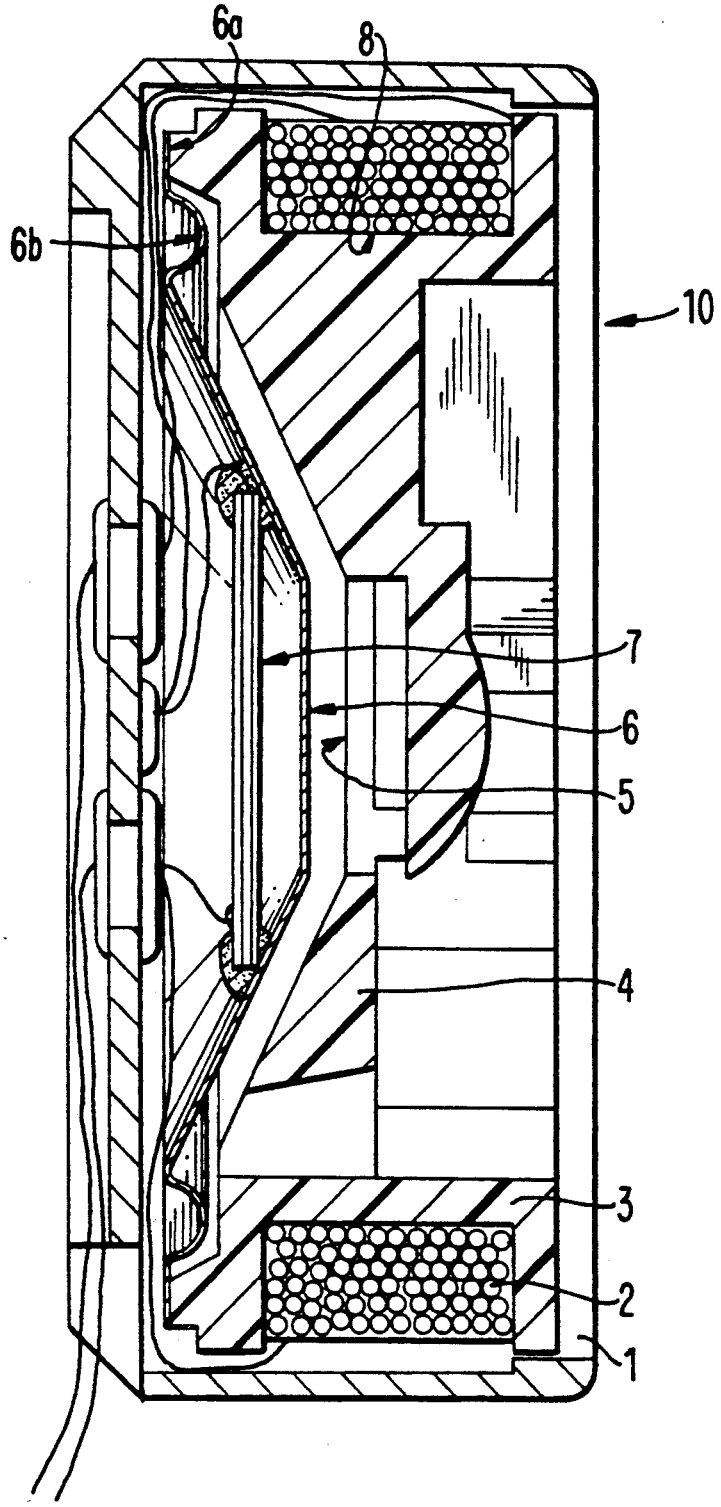
FIG. 1. is a cross-sectional view taken along line 1—1 of FIG. 2 illustrating a high frequency loudspeaker or tweeter constructed in accordance with the present invention.
Figure 2:
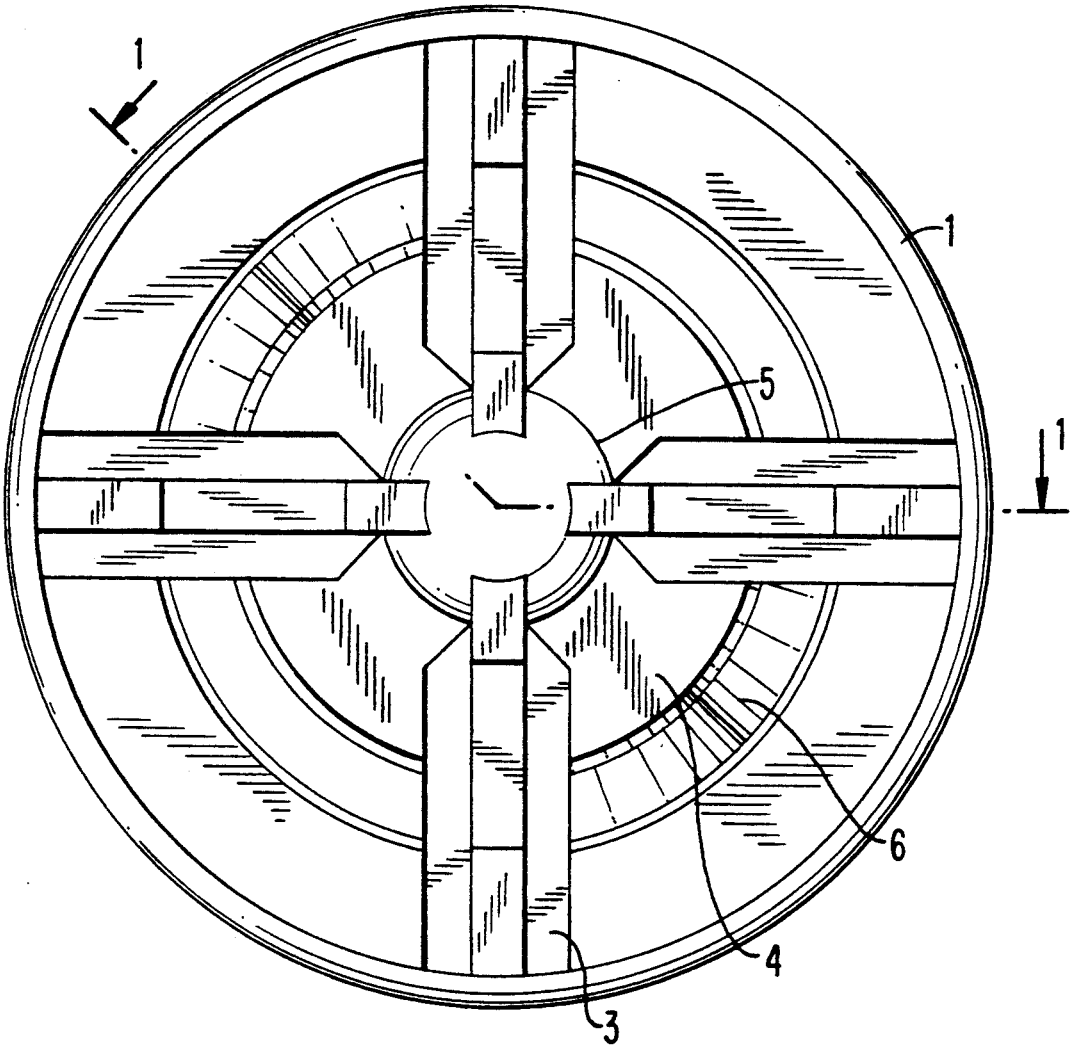
FIG. 2 is a front view of the tweeter illustrated in FIG. 1.

Referring now to the drawings wherein like reference characters designate identical or corresponding parts throughout the several views, a high frequency loudspeaker or tweeter, generally designated 10, constructed in accordance with the present invention, comprises a housing 1 in which a concave diaphragm 6 is mounted about an outer peripheral region *6a* thereof outwardly of a peripheral inflection region *6b*. The diaphragm 6 is mounted on a plastic mounting structure 3 which itself is mounted within housing 1. The housing structure has a recess 5 formed therein whose surface is in the shape of a truncated cone.

A substantially planar piezoelectric element 7 is affixed to a central region of the inner concave surface of the diaphragm 6 in a known manner for driving the diaphragm upon the application of an alternating voltage thereto. When the diaphragm 6 is driven, it vibrates and produces sound.

The piezoelectric element 7 is coupled in a circuit including a toroidal or ring-shaped coil 2. The coil 2 puts in motion and activates the piezoelectric element 7 to drive the diaphragm 6. In accordance with the invention, the coil 2, which may comprise a part of an air core transformer, is situated such that the inner region 4 of the surface of recess 5 is situated in a central interior region or space that is surrounded by coil 2. In the illustrated embodiment, the recess 5 extends into the central interior region of coil 2 and has a frusto-conical shape that terminates at a narrow end which is situated substantially at an axial mid-height region of the coil. The coil is mounted in the illustrated embodiment within an outwardly facing circular channel 8 formed in the plastic mounting structure of diaphragm 6.

It is seen from the foregoing that by positioning at least part of the diaphragm within the interior space defined by the coil, rather than adjacent to it, the height of the transducer is significantly reduced without an increase in its diameter which is fixed by the dimension of the diaphragm. A loudspeaker constructed as described above has technical performance characteristics which are superior to larger, conventional loudspeakers, and even superior to loudspeakers which utilize acoustic horns to increase performance.

Obviously, numerous modifications and variations of the present invention are possible in the light of the above teachings. For example, although the diaphragm is illustrated as having a generally frusto-conical shape, it is understood that the diaphragm may be dome-shaped, and the mounting structure therefore may be different from that illustrated. The piezoelectric element may be coupled to the diaphragm in an arrangement different from that illustrated in the preferred embodiment as will be understood by those skilled in the art. Further, the coil may be mounted on a separate mounting means from that in which the diaphragm is mounted. Accordingly, it will be understood that within the scope of the claims, the details of the invention may vary from the particular embodiment illustrated herein.

I claim:

1. An electroacoustic transducer, comprising:

a housing having a substantially frusto-conical recess defined therein;

a substantially ring-shaped coil mounted in said housing, said coil having an interior region;

a concave diaphragm mounted in said housing about an outer peripheral region of said housing, said concave diaphragm being situated within said substantially frusto-conical recess, at least a portion of said diaphragm being situated in said interior region of said coil and piezoelectric means coupled to said diaphragm for driving or being driven by said diaphragm, said coil structured and arranged to activate said piezoelectric means such that said diaphragm vibrates and produces sound.

2. A transducer according to claim 1 further including mounting means situated in said housing for mounting said diaphragm, said mounting means having said recess formed therein, said recess having a substantially frusto-conical shape terminating at a narrow end situated in said interior region of said coil substantially at an axial mid-height region thereof.

3. A transducer in accordance with claim 1 further including means situated in said housing for mounting both said diaphragm and said coil, said means including an outer channel in which said coil is situated, and an inner recess extending into an interior region surrounded by said channel.

4. A transducer in accordance with claim 1, wherein said coil comprises an air core transformer.

5. A transducer in accordance with claim 1, wherein said piezoelectric means being coupled in a circuit including said coil.

* * * * *